US006152102A

United States Patent [19]

Ruman

[11] Patent Number: 6,152,102

[45] Date of Patent: Nov. 28, 2000

[54] THROTTLE CONTROL SYSTEM FOR A STRATIFIED CHARGE INTERNAL COMBUSTION ENGINE

[75] Inventor: Mark A. Ruman, Fond du Lac, Wis.

[73] Assignee: Brunswick Corporation, Lake Forest, Ill.

[21] Appl. No.: 09/271,189

[22] Filed: Mar. 22, 1999

[51] Int. Cl.[7] ..... F02B 17/00

[52] U.S. Cl. ..... 123/295; 123/430; 123/399; 123/73 C

[58] Field of Search ..... 123/350, 399, 123/295, 430, DIG. 4, 403, 73 B, 73 C, 65 PE

[56] References Cited

U.S. PATENT DOCUMENTS

| | | | |
|---|---|---|---|
| 4,173,203 | 11/1979 | Nakajima | 123/119 |
| 4,185,599 | 1/1980 | Onoda et al. | 123/75 |
| 4,192,262 | 3/1980 | Onoda et al. | 123/75 |
| 4,289,094 | 9/1981 | Tanahashi | 123/69 |
| 4,668,199 | 5/1987 | Freund et al. | 440/89 |
| 4,920,932 | 5/1990 | Schlunke | 123/73 C |
| 4,969,435 | 11/1990 | Morikawa | 123/339 |
| 4,995,354 | 2/1991 | Morikawa | 123/65 |
| 5,054,444 | 10/1991 | Morikawa | 123/295 |
| 5,078,109 | 1/1992 | Yoshida et al. | 123/350 |
| 5,259,344 | 11/1993 | Huang et al. | 123/73 |
| 5,282,449 | 2/1994 | Takahashi et al. | 123/350 |
| 5,540,205 | 7/1996 | Davis et al. | 123/486 |
| 5,595,515 | 1/1997 | Hasegawa et al. | 440/89 |
| 5,609,021 | 3/1997 | Ma | 60/274 |
| 5,666,918 | 9/1997 | Pallett et al. | 123/350 |
| 5,832,895 | 11/1998 | Takahashi | 123/350 |
| 5,848,582 | 12/1998 | Ehlers et al. | 123/486 |

*Primary Examiner*—Willis R. Wolfe
*Assistant Examiner*—Hieu T. Vo
*Attorney, Agent, or Firm*—William D. Lanyi

[57] ABSTRACT

An engine control scheme determines the appropriate and desired magnitude of scavenging air flow for a two stroke engine as a function of both load and engine speed. The desired air flow is determined, as a function of engine load and engine speed, to achieve an optimal magnitude of emissions within the exhaust stream and to also optimize a reverse thrust capabilities of the marine propulsion system.

20 Claims, 7 Drawing Sheets

THROTTLE CONTROL SYSTEM FOR A STRATIFIED CHARGE INTERNAL COMBUSTION ENGINE

BACKGROUND OF THE INVENTION

1. Field of the Invention

The present invention is generally related to a system for controlling air flow into an internal combustion engine and, more particularly, to a system which monitors air flow into an engine and modifies a throttle position to optimize the scavenging air flow according to a preselected schedule based on the load on the engine and engine speed.

2. Description of the Prior Art

Many different types of fuel delivery systems are known to those skilled in the art. In addition, many types of control systems are known which vary either the fuel or the air supplied to an internal combustion engine to affect its operation.

U.S. Pat. No. 4,969,435, which issue Morikawa et al on Nov. 13, 1990, describes an idle speed control system for a two cycle engine. The engine has a scavenged pump provided in an intake passage and a fuel/air injection provided for injecting fuel directly in a cylinder of the engine together with air. A control unit has a calculator for calculating quantities of fuel and air injected from the fuel/air injector and for producing a fuel injection pulse width signal and an air injection pulse width signal based on the calculated quantities. Engine speed at idling state is compared with a desired idle speed and an error signal is produced. At least one of the pulse width signals is corrected with a correction value for controlling the injection quantity so as to cause the idle speed to converge to the desired idle speed.

U.S. Pat. No. 4,995,354, which issued to Morikawa on Feb. 26, 1991, discloses a two cycle engine which has a fuel inject, scavenge port and an exhaust port which is provided with a scavenge pump for supplying scavenging air into a cylinder. An exhaust rotary valve is connected to the exhaust port to open and close the port. Similarly, a scavenge rotary valve is connected to the scavenge port to open and close the port. Engine operating condition including engine speed and degree of depressing the accelerator pedal, representing the engine load, is inputted to a control unit, which variably controls the timings of opening and closing the exhaust and scavenge rotary valves in accordance with the engine operating condition.

U.S. Pat. No. 5,848,582, which issued to Ehlers et al on Dec. 15, 1998, discloses an internal combustion engine with barometric pressure related start of air compensation for a fuel injector. The control system for a fuel injector system for an internal combustion engine is provided with a method by which the magnitude of the start of air point for the injector system is modified according to the barometric pressure measured in a region surrounding the engine. This offset, or modification, of the start of air point adjusts the timing of the fuel injector system to suit different altitudes at which the engine may be operating.

U.S. Pat. No. 5,540,205, which issued to Davis et al on Jul. 30, 1996, describes an air fuel ratio control system. The method of controlling the mass of air delivered to an internal combustion engine per cylinder, per cycle, by utilizing a unique control algorithm is described.

U.S. Pat. No. 5,609,021, which issued to Ma on Mar. 11, 1997, describes the operation of an internal combustion engine. A method is described for operating an internal combustion engine burning a fuel containing carbon and hydrogen to provide a flame in the exhaust system to heat a catalytic converter or burn off the soot in a particulate filter trap. The method involves reducing the intake throttle opening during deceleration mode below the throttle opening for the steady speed idle position to create a proportion of combustible gases in the exhaust gas stream. By ensuring at the same time the presence in the exhaust gas stream of additional air, an ignitable mixture is produced which is ignited to burn as a flame in an afterburner chamber of the exhaust system. By selecting deceleration periods to enrich the mixture excessively in this manner, adverse effects on drivability are unnoticed.

U.S. Pat. No. 4,173,203, which issued to Nakaijima et al on Nov. 6, 1979, discloses an engine system. The engine system comprises an internal combustion engine, an air admission system to admit scavenging air, under pressure, into an engine cylinder through an additional intake valve and an EGR system. The air admission system includes an air pump and an EGR (exhaust gas recirculation) conduit of the EGR system having an inlet end connected to the engine exhaust conduit and an outlet end connected to the air admissions system upstream of the air pump to effect admission of recirculated exhaust gas through the additional intake valve together with scavenging air. With this EGR system and the replacement of residual gas with scavenging air, the rate of exhaust gas in the engine cylinder upon ignition is kept substantially constant over varying partial loads.

U.S. Pat. No. 4,192,262, which issued to Onoda et al on Mar. 11, 1980, describes a control system for varying the amount of scavenging air to be admitted to internal combustion engines. The control system is adapted for an internal combustion engine in which a jet of air is injected into each combustion chamber via a second intake valve during each exhaust cycle and the subsequent intake cycle. The system comprises a source of compressed air having a pressure to be varied in accordance with the engine speed, an injection passageway leading from the source toward each second intake valve and a flow controller operated in accordance with changes in intake manifold vacuum. The flow controller includes a scheduled flow area therethrough to increase, under conditions in which the engine speed is constant, the amount of air passing through the injection passageway in accordance with increasing engine load in such a way so as to increase the ratio of air flow through the injection passageway to the intake airflow to the engine under light engine load in order to cope with increasing residual gas fraction within each combustion chamber when the engine idles or operates under deceleration of the vehicle.

U.S. Pat. No. 4,185,599, which issued to Onoda et al on Jan. 29, 1980, describes a control system for varying the amount of scavenging air to be admitted to internal combustion engines. The control system is adapted for an internal combustion engine in which a jet of air is injected into a combustion chamber via a second intake valve during a period overlapping an exhaust cycle and the subsequent intake cycle for expelling residual gas within the combustion chamber in order to reduce residual gas fraction of charge for the subsequent combustion within the combustion chamber. The system comprises a source of compressed air having a constant pressure, an injection passageway leading from the source toward the second intake valve, a flow control valve fluidly disposed in the injection passageway, and means whereby the flow control valve will vary effective flow area of the injection passageway in response to a signal indicative of the flow rate of fluid passing through the engine induction passageway.

U.S. Pat. No. 5,832,895, which issued to Takahashi et al on Nov. 10, 1998, describes a control system for an internal combustion engine. The control system is for an internal combustion engine having an air intake amount regulating device and a fuel supply device. The control system comprises a device for detecting an engine operating condition of the engine, and a control unit. The control unit is configured to perform the steps of calculating a base fuel supply of fuel to be supplied to a combustion chamber of the engine in accordance with the engine operating, calculating a lean limit air-fuel ratio in accordance with the engine operating condition, stable combustion in the combustion being impossible at the air-fuel ratio leaner than the lean limit air-fuel ratio, calculating a target intake air amount of intake air to be supplied to the combustion chamber, required for meeting the basic fuel supply amount and the lean limit air-fuel ratio, controlling the intake air amount regulating device so as to regulate an intake air amount of the intake air to the target intake air amount and controlling the fuel supply device so as to regulate a fuel supply amount of the fuel to realize the lean limit air-fuel ratio, within a first engine operating condition (such as an idle condition) which is within a predetermined low range in engine speed and in engine load, and controlling the intake air amount regulating device so as to increase the intake air amount to fall within a high range between the maximum level and a level lower a predetermined amount than the maximum level and controlling fuel supply device so as to supply the fuel such that the air-fuel ratio falls within a predetermined range, within a second engine operating condition which is higher in at least one of engine speed and engine load than the first engine operating condition.

U.S. Pat. No. 5,054,444, which issued to Morikawa on Oct. 8, 1991, describes a fuel injection control system for a two cycle engine. The two cycle engine has a fuel injector provided for injecting fuel directly into a cylinder of the engine. An amount of air actually induced into the cylinder is calculated based on the amount of escape air and the amount of intake air detected by an air-flow meter. The quantity of fuel injected by the fuel injector is calculated based on the engine speed and the amount of air induced in the cylinder. The timing of the fuel injection is advanced as engine load increases and the duration of fuel injection increases as the engine load and engine speed increase.

U.S. Pat. No. 4,668,199, which issued Freund et al on May 26, 1987, discloses an idle exhaust relief system for outboard motors. The invention is an exhaust system for an outboard motor which includes a main exhaust passageway extending through a partially water filled chamber in the drive shaft housing. An inlet idle relief passage connects the top of the chamber with the main exhaust passageway and an outlet passage connects the top of the chamber with the atmosphere. The system thus defines an effective exhaust silencer for the idle exhaust.

U.S. Pat. No. 5,595,515, which issued to Hasegawa et al on Jan. 21, 1997, describes an outboard motor exhaust system which includes a simplified above-the-water exhaust gas discharge which is formed by an inverted U-shaped tube that is detachably connected into the outer casing of the driveshaft housing so that the outer casing need not be form with special passages for providing for exhaust gas flow.

U.S. Pat. No. 4,289,094, which issued to Tanahashi on Sep. 15, 1981, discloses a two cycle gasoline engine. The engine has a first scavenging port which is supplied with fuel-air mixture through a mixture passage, and a second scavenging port which is supplied with air, wherein supply of fuel-air mixture through the mixture passage is substantially throttled while supply of air through the second scavenging port is interrupted, so as to perform stratified scavenging, when the engine is operating at low load, while in medium to high load operation the throttling of the mixture passage is released while air is injected through said second scavenging port, so as to generate swirling of mixture charged in the cylinder chamber.

U.S. Pat. No. 5,259,344, which issued to Huang et al on Nov. 9, 1993, discloses an intermittent fuel-injection method and device for a two stroke engine. The method for a two stroke engine, which is done by means of an injection nozzle mounted under a cylinder head or on cylinder wall so as to have fuel directly injected into a cylinder to mix the air inside the cylinder into a homogeneous mixture includes a controller for use in controlling the fuel injection timing and quantity. The controller determines the injection timing and quantity in accordance with the engine intake airflow quantity and engine rpm. Under idle running conditions or low load running conditions, an intermittent fuel injection control method is used so as to enable an engine to perform one, two, three, four or five scavenging and exhaust cycles after one fuel injection cycle in order to obtain a steady and high combustion efficiency.

The above described patents are hereby explicitly incorporated by reference in this description of the present invention.

Those skilled in the art of internal combustion engines are familiar with many different techniques to regulate the air intake into the engine as a function of the fuel which is introduced into the combustion chambers of the engine. Some internal combustion engines incorporate fuel injection which can be a direct fuel injection (DFI) system that injects a mixture of fuel and air directly into the combustion chamber. In addition, those skilled in the art are familiar with many types of scavenging systems used in two cycle engines for the purpose of removing the exhaust products from the combustion chambers following the ignition of the fuel and air mixture within the combustion chamber. Some scavenging systems use auxiliary pumps to provide additional scavenging air into the combustion chambers.

In an engine that provides a stratified charge within a combustion chamber, the magnitude of pollutants within the exhaust stream from a combustion chamber does not vary directly with the magnitude of scavenging air at all rates of airflow provided to the combustion chamber following ignition. Instead, there exists an optimum rate of air flow of scavenging air which results in a minimum amount of unburned hydrocarbons in the exhaust steam. For a specific airflow, a minimum level of exhaust pollutants can be achieved, with greater amounts of exhaust pollutants at both lesser and greater magnitudes of airflow. This optimum air flow magnitude varies as a function of load on the engine and engine speed.

In internal combustion engines used for marine propulsion systems, an additional variable, which is dependant on the magnitude of air intake, must be considered. Many types of marine propulsion systems direct the exhaust products through the hub of a propeller to be exhausted beneath the water level of the body of water in which the marine vessel is operated. Generally, these marine systems also provide an idle relief port, or alternate exhaust port, in addition to the exhaust path through the propeller hub. When the marine propulsion system is operated in reverse gear, exhaust products emanating from the propeller hub are drawn back into the region of the rotating propeller blades. This extreme aeration of the propeller blade region seriously affects the efficiency of the marine propulsion system when operated in reverse gear and deleteriously affects the efficiency of the system.

The amount of exhaust products emanating through the propeller hub is directly affected by the amount of air introduced into the combustion chamber of the engine. Very high rates of intake air flowing into the combustion chamber will result in an exhaust stream of increased pressure and flow rate. This increased pressure and flow will cause a higher percentage of the exhaust stream to flow through the propeller hub below the surface of the water. Lower pressures and flow rates of the exhaust stream will result in a higher percentage of exhaust passing through the idle exhaust relief ports above water and away from the propeller blades and, as a result, the extreme aeration of the propeller blades during reverse operation of the marine propulsion system will be significantly less.

In view of the above, it can be seen that the amount of intake air provided to the cylinders of the internal combustion engine can affect the operation of the marine propulsion system in at least two ways. First, the amount of unburned hydrocarbons in the exhaust stream can be adversely affected if the scavenging air flow is either too low or too high. Secondly, the efficiency of the marine propulsion engine, when operated in reverse gear, can be adversely affected if the air intake flow rate is too high. It would therefore be significantly advantageous, particularly in internal combustion engines used for marine propulsion systems, if the air flow into an internal combustion engine can be regulated to optimize both of these conditions.

SUMMARY OF THE INVENTION

A preferred embodiment of the present invention is a method for controlling the operation of an internal combustion engine comprising the steps of creating an least a partially stratified charge of fuel and air within a combustion chamber of the engine, determining a preselected parameter of the engine, determining an actual air flow into the combustion chamber, selecting a desired air flow into the combustion chamber as a function of the preselected parameter, and changing the throttle position of the engine to cause the actual air flow to be generally equal to the desired air flow. The at least partially stratified charge of fuel and air within the combustion chamber can be accomplished by the direct fuel injection (DFI) system. The preselected parameter of the engine, in a particularly preferred embodiment of the present invention, is the load on the engine. In addition, the load can be combined with engine speed to form a parameter that is used to determine the desired air flow into the combustion chamber. The actual air flow into the combustion chamber can be determined as a function of the manifold absolute pressure (MAP), the engine speed (RPM), and the air temperature. Alternatively, a throttle position measured by a throttle position sensor (TPS) can provide an estimation of the air flow into the engine. Furthermore, the actual air flow into the engine can be directly measured by a mass air flow sensor (MAFS) for a hot wire anemometer. The throttle can be changed by a stepper motor controlled by an engine control unit (ECU) or engine control module (ECM).

The actual air flow into the engine can be calculated as a function of barometric pressure, manifold absolute pressure, air temperature, a signal from a mass air flow sensor (MAFS), a signal from a throttle position sensor (TPS), or any other applicable method which can provide the engine control module with sufficient information to determine the actual air flowing into the combustion chamber of the engine.

The method of the present invention can be performed by a system that comprises a means for creating at least a partially stratified charge of fuel and air within the combustion chamber, a means for determining the magnitude of a preselected parameter, a means for determining an actual air flow into the combustion chamber, the means for selecting a desired flow into the combustion chamber as a function of preselected parameter, and a means for changing the throttle position.

The method of the present invention, in essence, comprises two basic steps. The first step is providing at least a partially stratified charge of fuel and air into a combustion chamber of the engine. The second step is controlling the air flow into the combustion chamber of the engine to achieve a preselected level of optimization of charge purity within the combustion chamber. The level of optimization of charge purity may not be a maximum magnitude of charge purity but, instead, a preselected level of optimization of charge purity that achieves certain predefined objectives. These objections can comprise both reduced levels of unburned hydrocarbons in the exhaust stream and acceptable levels of reduced thrust when the marine propulsion system is in reverse gear.

BRIEF DESCRIPTION OF THE DRAWINGS

The present invention will be more fully and completely understood from a reading of the description of the preferred embodiment in conjunction with the drawings, in which.

DESCRIPTION OF THE PREFERRED EMBODIMENT

Figure 1:
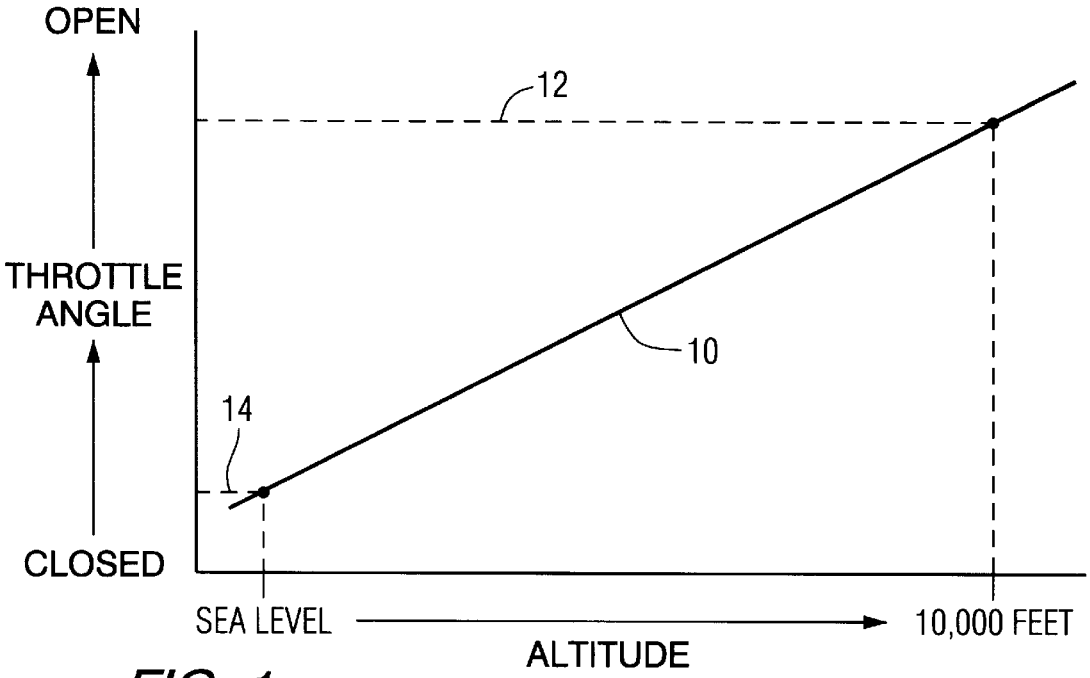
FIG. 1 is a graphical representation of the relationship between altitude and throttle position to achieve a constant air flow.

Throughout the description of the preferred embodiment of the present invention, like components will be identified by like reference numerals.

Two cycle internal combustion engines that use a direct fuel injection system (DFI) or other fueling arrangements that result in the provision of a stratified charge of fuel and gas within the combustion chamber typically use intake air primarily to perform a scavenging function. In engines with at least a partially stratified charge within the combustion chamber, excess air through the intake system of the engine is not generally required to assure proper ignition within the combustion chamber. This additional air does not increase the torque or speed of the engine since stratified charge engines do not rely on incoming air flow to determine their output. Unlike carburated engines or other engines with a homogeneous charge, in which the rate of air flow through the intake manifold of the engine determines the torque and speed of the engine, stratified charged engines are controlled by the quantity of fuel and air within the stratified charge. For example, in a direct fuel injection (DFI) system, the magnitude of fuel injected into the combustion chamber determines the engine's torque output. Additional air received through the intake manifold of the engine serves to affect the scavenging capability of the engine, but does not change the output of the engine.

The mass airflow into an engine's intake manifold is a direct function of the density of the air if all other variables are equal. For example, FIG. 1 shows a line 10 that represents the relationship between altitude and the required throttle angle to maintain a constant mass air flow into an engine. In other words, the throttle angle represented by dashed line 12 is required to allow a certain fixed mass air flow into an engine if the engine is operated at an altitude of 10,000 feet. That same mass air flow into the engine can be achieved at sea level with the throttle angle represented by dashed line 14. In view of FIG. 1, it can be seen that a fixed throttle position setting for idle operation of an engine which is calibrated at sea level will not permit a sufficient mass air flow of air into the engine if the engine is operated at 10,000 feet because a throttle angle represented by dashed line 12 would be required. Conversely, if the throttle plate angle is calibrated for idle engine operation at 10,000 feet altitude, too much mass air flow will flow into the engine when it is operated at sea level. Unfortunately, engines known to those skilled in the art are typically calibrated by manually setting a mechanical stop to fix the position of the throttle plate when the engine is operated at idle speed. If this mechanical setting is made at 10,000 feet, the engine will receive too much mass air flow when operated at sea level.

Figure 2:
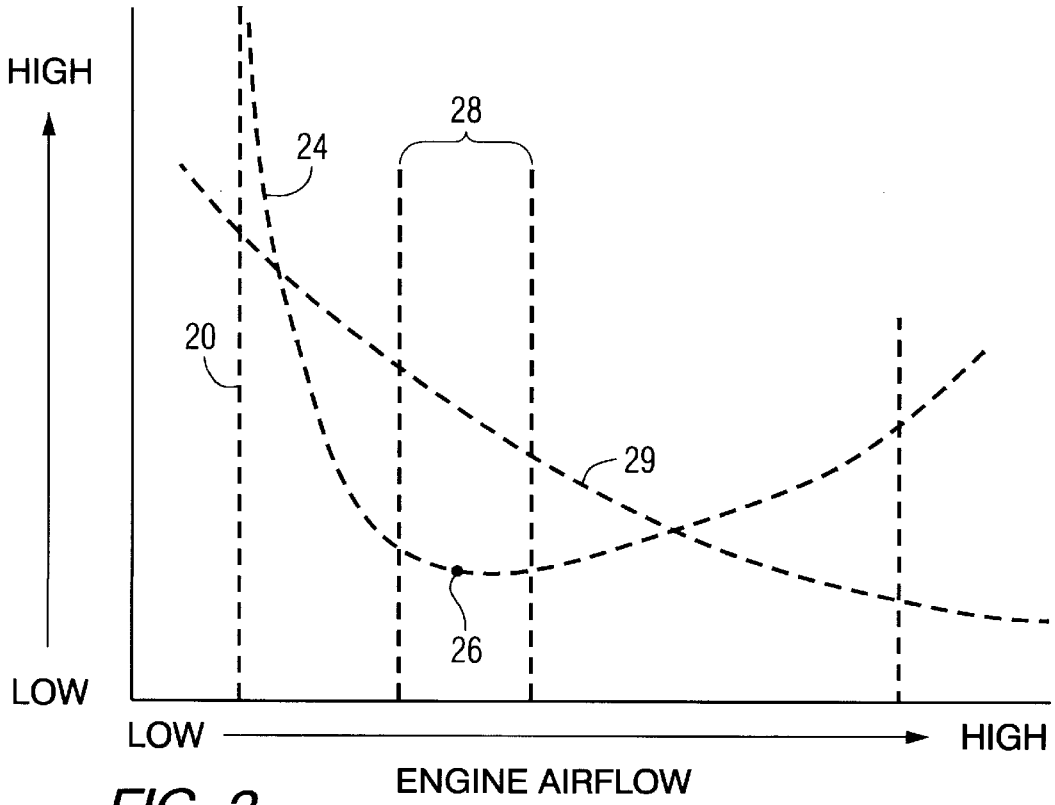
FIG. 2 is a graphical representation of both emission level in the exhaust stream and reverse thrust as a function of engine air flow.

It is important to provide a proper mass air flow for scavenging purposes in an engine with a stratified charge or at least a partially stratified charge. The scavenging function is important to assure that the burned and partially burned products of combustion are appropriately removed from the combustion chamber and transported to the exhaust stream. Insufficient scavenging can result in excessive retention of burned combustion products within the combustion chamber to such a degree that subsequent cycles of the engine are unable to achieve proper combustion, resulting in more unburned hydrocarbons. In FIG. 2, dashed line 20 represents this condition. It can be seen that dashed line 24, which represents the level of emissions in the exhaust stream of the engine is assymptotic to dashed line 20. As the engine air flow is reduced, dashed line 24 approaches dashed line 20 and the level of emissions rises significantly. This is obviously an undesirable characteristic because the engine will not operate properly under these conditions and emissions within the exhaust stream will be unacceptably high. It can also be seen in FIG. 2 that increase in engine air flow beyond a hypothetical ideal point 26 can also result in an increase in exhaust emissions. For example, if the scavenging air flow is so high that virtual all of the products of combustion are forced out of the combustion chamber following every combustion cycle, the exhaust stream will contain all of the unburned hydrocarbons from the previous combustion event. Since combustion is not perfectly efficient within the combustion chamber, some hydrocarbons remain unburned during each combustion event. Complete scavenging, which results from a very high mass air flow into the combustion chamber subsequent to combustion will force all of these unburned hydrocarbons into the exhaust stream and into the environment. It is known that a more beneficial mode of operation is to retain a certain percentage of the products of combustion within the combustion chamber following an ignition event so that the retained unburned hydrocarbons can be burned during the following cycle. Because of this result, dashed line 24 increases with increasing engine air flow beyond point 26. Another disadvantage can occur as a result of mass air flow into the engine that is too high. Increasing oxygen provided with the increased scavenging air flow provides additional oxygen that can result in higher $NO_x$ emissions. Furthermore, mass air flow into the combustion chamber that is too high can also result in an abnormal cooling of the combustion chamber which can reduce the temperature of the stratified charge of fuel and air to a magnitude that is less than optimal for near complete combustion of the fuel. In view of the above, it can be seen that an optimal engine air flow range, identified by reference numeral 28 in FIG. 2, can be selected based on the level of emissions represented by dashed line 24.

Figure 3:
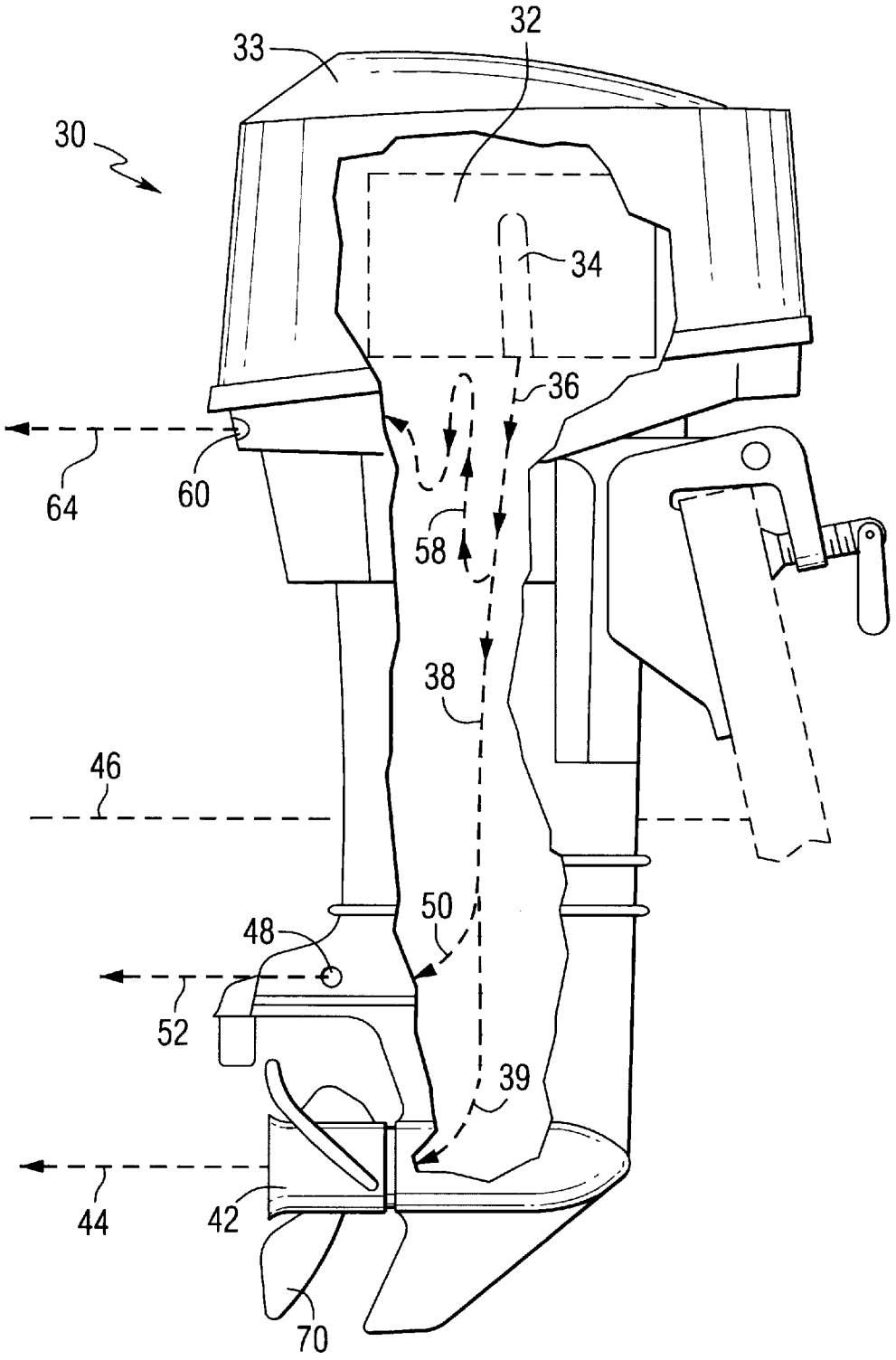
FIG. 3 is a sectional view of an outboard motor showing various alternative exhaust stream paths.

Line 29 in FIG. 2 represents a hypothetical relationship between the reverse thrust capability of a marine propulsion system, such as an outboard motor, and engine air flow. Line 29 indicates that low engine air flow results in a higher reverse thrust capability and a higher engine air flow results in a lower reverse thrust capability. FIG. 3 illustrates the reasons behind the relationship represented by line 29 in FIG. 2.

With reference to FIG. 3, an outboard motor 30 comprises an engine 32, represented by dashed lines, within the cowl 33. An exhaust manifold 34 is represented by dashed lines and an exhaust stream 36 is represented by the dashed line arrows in FIG. 3. The exhaust stream from the exhaust manifold 34 can flow along 3 alternative paths. One path, represented by dashed arrows 38 and 39, direct the exhaust through the hub 42 of a propeller. That exhaust 44 is emitted under the level of the water, represented by dashed line 46. An alternative underwater exhaust port 48 is provided through the housing in some outboard motor designs and allows a portion of the exhaust, represented by arrows 38 and 50, to be emitted underwater as represented by dashed line 52. Another exhaust stream, represented by dashed arrows 58 passes through a serpentine path within the structure of the outboard motor 30 and exits from an idle relief port 60 into the air as represented by reference numeral 64. It can be understood that a low flow of exhaust, at a relatively low pressure, will tend to flow in the direction represented by dashed arrows 58 to exhaust through the idle relief port 60. Low exhaust pressures can be insufficient to take paths 50 and 39 because they are too low to overcome the increased pressure resulting from the fact that the exhaust port 48 and the propeller hub 42 are both submerged underwater and, as such, experience a higher resistance to exhaust gas emission through those paths. As the exhaust pressure increases, because of an increased intake air flow, the exhaust stream can overcome the resistance of the underwater exhaust passages and flow into the water through these alternative pathways. When the outboard motor 30 is operated in a forward gear, the presence of exhaust gas in the region of the propeller hub 42 does not present a significant disadvantage. However, when the outboard motor 30 is operated in reverse gear, the presence of exhaust gas emanating from the hub 42 will allow the exhaust to be drawn into the region of the propeller blades 70. The presence of a gas in the region of the propeller blades 70 creates excessive aeration and significantly reduces the efficiency of the propeller's operation. This reduces the reversed thrust capabilities of the marine propulsion system. If engine air flow into the engine 32 is increased, a higher percentage of the exhaust will flow through the hub 42 of the propeller. As a result, reverse thrust will be deleteriously affected. With reference to FIGS. 2 and 3, line 29 in FIG. 2 shows the result of higher engine air flow that causes more exhaust to flow along dashed line 39 and exit the hub 42 of the propeller shown in FIG. 3. Therefore, it can be seen that increased exhaust pressure, which can result from increased scavenging air flow in the combustion chamber, can result in increased exhaust through the propeller hub 42. This, in turn, will reduce the reversed thrust capabilities of the marine propulsion system.

With reference to FIG. 2, the precise shape and position of curve 24, which represents the emission level within the exhaust stream, depends on several factors. The scavenging process of a two stroke engine requires several different parameters to fully characterize its effectiveness. These parameters include the delivery ratio, as defined below in equation 1, which defines how much air is supplied or delivered to the engine cylinder for each cycle of the piston. In addition, the trapping efficiency, which is described below in equation 2, defines how much air does not flow straight through the cylinder and is unused. In other words, some of the scavenging air will flow from the scavenging port through the combustion chamber and out through the exhaust port without participating in a combustion cycle. Furthermore, the scavenging efficiency, which is defined in equation 3 below, describes how effectively the burned gases in the cylinder from the previous cycle have been replaced with fresh air.

$$\text{Delivery Ratio}=(\text{mass of delivered air per cycle})/\text{reference mass} \quad (1)$$

$$\text{Trapping Efficiency}=(\text{mass of delivered air retained})/\text{mass of delivered air} \quad (2)$$

$$\text{Scavenging Efficiency}=(\text{mass of delivered air retained})/\text{mass of trapped cylinder charge} \quad (3)$$

Figure 4:
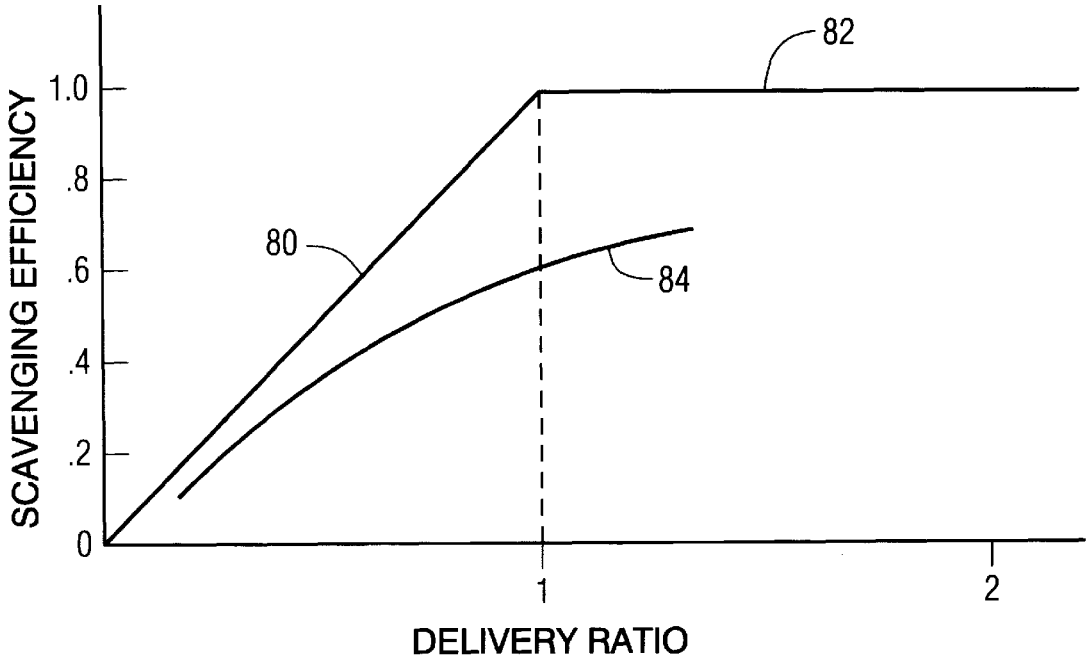
FIG. 4 shows the relationship between scavenging efficiency and delivery ratio.

FIG. 4 is a graphical representation of the scavenging efficiency, as described in equation 3 above, as a function of the delivery ratio, as described in equation 1 above. Lines 80 and 82 define the theoretical relationship for a perfect displacement scavenging situation. Curved line 84 represents a perfect mixing line as described in equation 4 below, where SE represents scavenging efficiency and SR represents delivery ratio under a perfect mixing condition. The space between line 84 and lines 80 and 82 contains and defines the range of actual scavenging performances for two stroke engines.

$$SE=1-e^{-SR} \quad (4)$$

Figure 5:
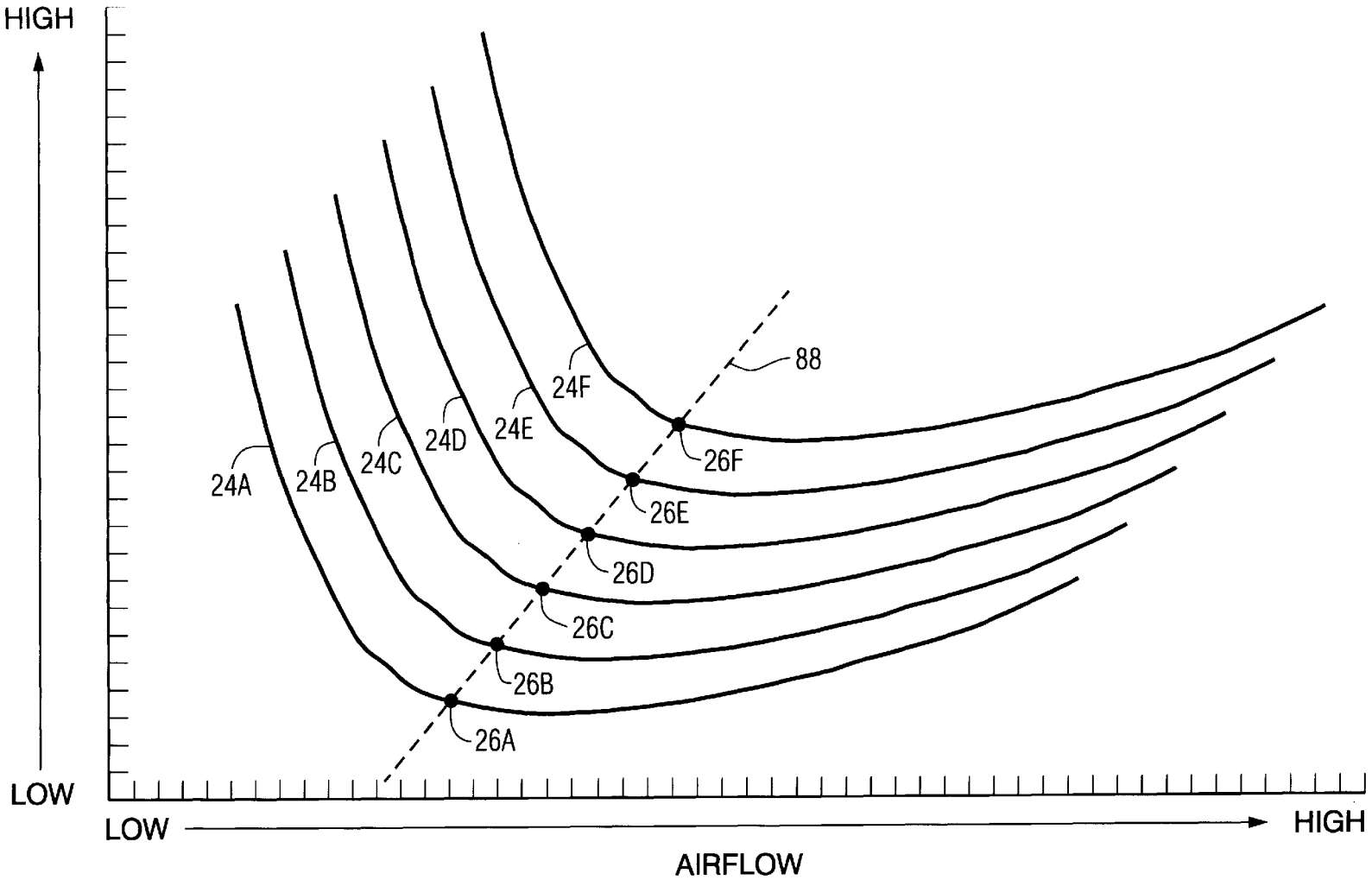
FIG. 5 shows a plurality of emission curves for various loads and/or engine speeds.

FIG. 5 shows a family of curves, wherein each curve represents the relationship between mass flow rate of emissions in the exhaust stream and engine air flow for a different set of conditions relating to the load on the engine and engine speed. Curves 24A–24F in FIG. 5 are similar to curve 24 in FIG. 2, but curve 24 in FIG. 2 represents the relationship between the emissions in the exhaust stream and mass air flow for only one load and engine speed combination. With reference to FIGS. 2 and 5, it can be seen that the single ideal point 26 in FIG. 2 changes to a series of points 26A–26F in FIG. 5. These points generally lie along dashed line 88 in this hypothetical example. As can be seen in FIGS. 2 and 5, the appropriate setting of a mass air flow magnitude for an internal combustion engine depends on the magnitude of the load on the engine. Depending on the particular way in which the present invention is applied to a given situation, both load and engine speed can be used in combination to determine a particular relationship, 24A–24F, between emissions in the exhaust stream and mass air flow.

In order to properly control the mass air flow into the engine to achieve an optimal situation, such as represented by reference numeral 28 in FIG. 2, it is necessary to measure or calculate the actual air flow into the engine. Stored data can allow a microprocessor to determine a desired air flow based on the relationships shown in FIG. 5, but it is necessary to measure or calculate the actual air flow so that the throttle plate can be used to achieve the desired air flow.

As shown below in equation 5, the mass of air (M) inducted into an internal combustion engine can be calculated by measuring the manifold absolute pressure (MAP) which is represented by P in equation 5, the displacement V of the cylinder, the volumetric efficiency $n_v$, the ideal gas constant R, and the absolute manifold temperature T.

$$M=(PVn_v)/(RT) \quad (5)$$

The mass air flow calculated by equation 5 represents the mass of air that flows into a cylinder for each cycle of the piston. To calculate the actual total mass of air flowing into the engine, several sensors are typically required. Engine speed can be determined from a timing signal or tachometer that provides the engine speed in revolutions per minute (RPM). Manifold absolute pressure (MAP) can be determined by a piezoelectric sensor in the manifold which measures manifold pressure to allow an engine control module (ECM) to compute the air density. Manifold absolute temperature can be measured by a thermistor that is located near the piezoelectric sensor which measures manifold absolute pressure (MAP). The temperature value is also required to permit the engine control module to compute the air density. A throttle position indicator or throttle position sensor (TPS) can be a potentiometer that is mounted on the throttle shaft to measure the angle of the throttle plate. In combination with engine speed, the throttle position indicator can provide empirically determined information about volumetric efficiency.

Figure 6:
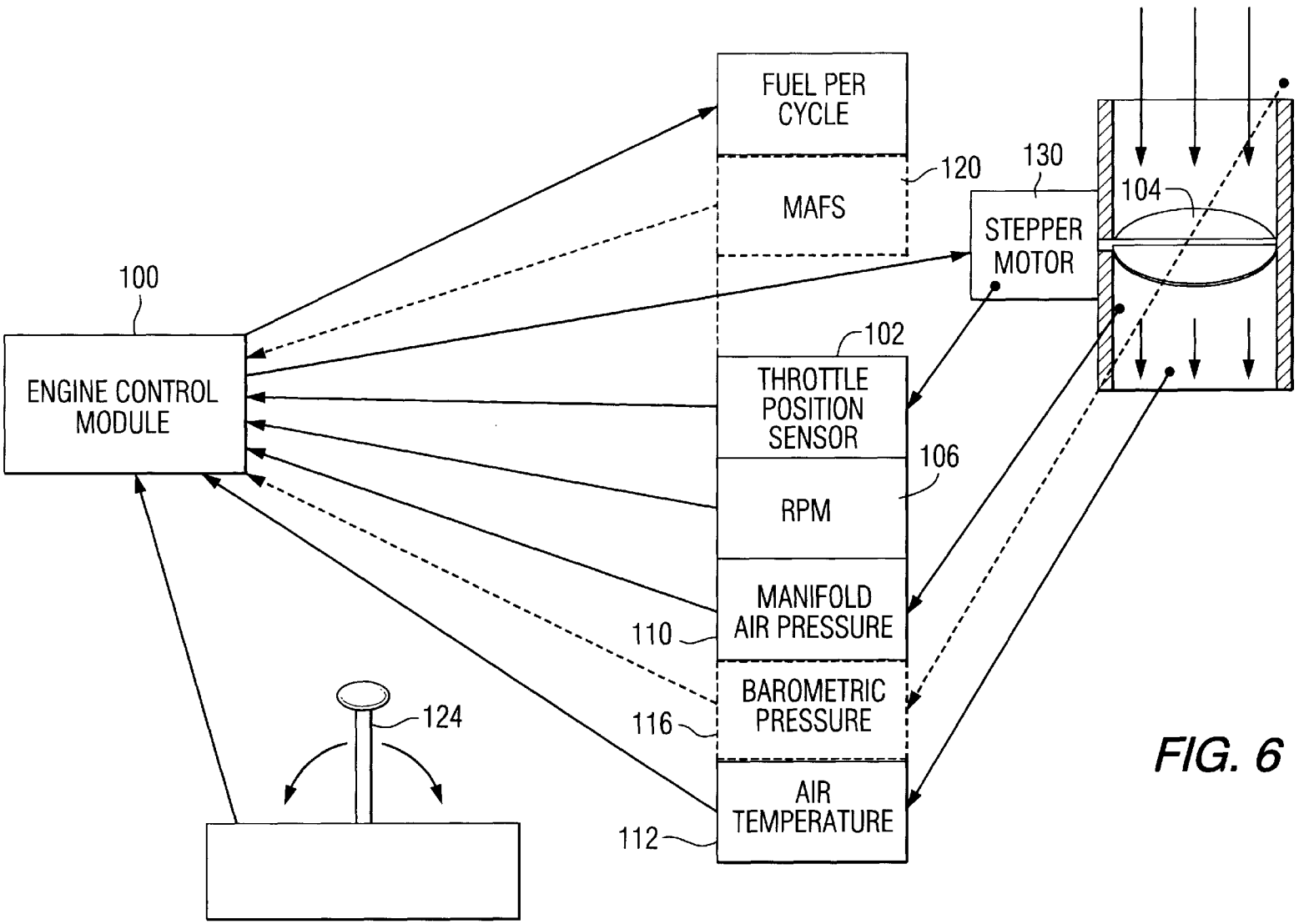
FIG. 6 is a graphical representation of a control system for an internal combustion engine.

FIG. 6 is a simplified graphical representation of an engine control system that can perform the method of the present invention. The engine control module (ECM) 100 in FIG. 6 receives input from various sensors. The throttle position sensor 102 provides a signal that defines the position of the throttle plate 104. A tachometer or other suitable sensor to measure speed provides a signal to the engine control module 100 representing the RPM of the engine. The manifold air pressure 110 and manifold air temperature 112 are also provided as signals to the engine control module 100. In FIG. 6, it can be seen that the air temperature and manifold air pressure are measured at positions near each other. The barometric pressure 116 can be measured by a separate pressure sensor other than the manifold air pressure 110, but it is common to use the manifold air pressure sensor during the start up procedure, before significant air flow exists within the manifold, to obtain a measurement that is representative of barometric pressure. In addition, a mass air flow sensor (MAFS) 120 can alternatively be used to directly measure the mass air flow through the manifold rather than calculate this value as described above. The mass air flow sensor 120 and barometric pressure sensor 116 are shown in dashed line boxes to represent the fact that they can be omitted in many different types of embodiments of the present invention.

With continued reference to FIG. 6, a signal can be provided to the engine control module 100 that represents the position of a control handle 124. The operator of a marine vessel controls the direction (e.g. forward or reverse) and the speed of the marine propulsion system through the use of a control handle 124. In certain types of drive by wire systems, a signal can be provided to the engine control module 100 from circuitry related to the control handle 124 and the engine control module 100 then provides a fuel per cycle (FPC) signal to the fuel injection system. As is generally known to those skilled in the art, the fuel per cycle (FPC) signal relates to the amount of liquid fuel that is injected into a holding chamber prior to its injection, and with a prescribed quantity of pressurized air in the case of air-assisted injection systems, directly into the combustion chamber of a cylinder. This injection of the fuel and air charge forms a stratified charge within the combustion chamber. The air incorporated in the fuel/air charge injected by the fuel injection system into the cylinder is independent from the air inducted into the engine through the manifold. In an engine that has a stratified charge, a torque provided by the combustion of the fuel and air mixture is generally independent of the air flow into the manifold for mixtures which are sufficiently lean of stoichiometric. Rather than affecting the torque provided by the engine, the inducted mass air flow through the manifold affects the scavenging performance of the engine, as described above.

With continued reference to FIG. 6, the engine control module 100 also controls a stepper motor 130 which rotates the shaft of a throttle plate 104. In this way, the engine control module can change the rate of air flow into the engine. After calculating a desired air flow, the engine control module 100 controls the actual air flow by moving the throttle plate 104 through the use of the stepper motor 130. The throttle plate 104 is moved until the actual air flow through the manifold generally equals the desired air flow determined by the engine control module as a function of the load on the engine alone or in combination with the engine speed.

Figure 7:
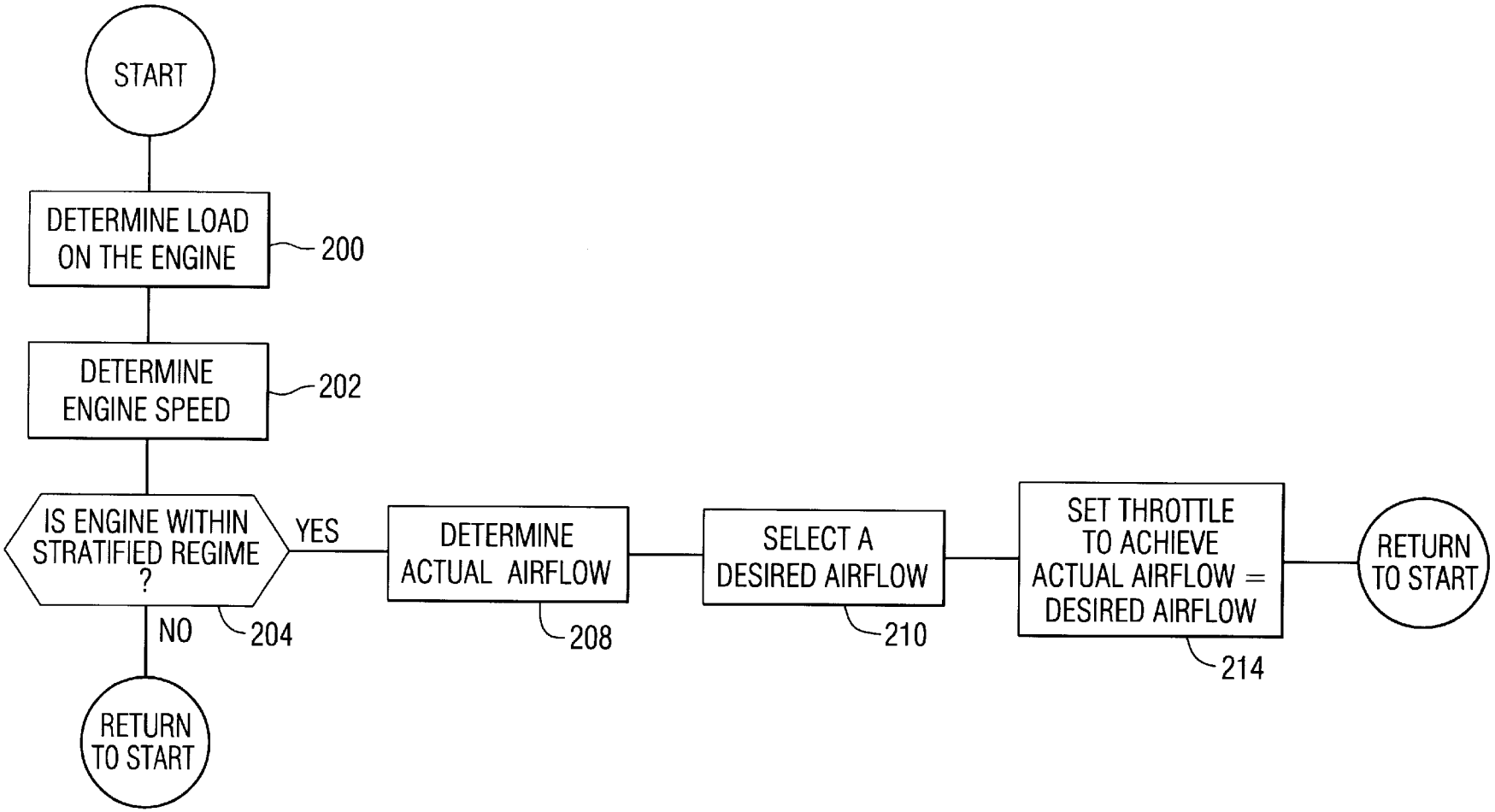
FIG. 7 is a flow chart describing the major steps of the present invention.

FIG. 7 represents a simplified flow chart showing the steps taken by the present invention to perform the function of selecting the desired air speed to achieve an optimal relationship, as described above in conjunction with FIG. 2, for the particular load and engine speed as described above in conjunction with FIG. 5. In FIG. 7, the engine control module first determines the load on the engine and the engine speed, as represented by boxes 200 and 202. The load on the engine can be determined from the fuel per cycle (FPC) commanded by the engine control module to the fuel injection system. The fuel per cycle (FPC) varies directly with the load on the engine and can be used as a representative value in determining the load. Engine speed can be determined in many different ways. A tachometer, for example, can be used to provide that is representative of the revolutions per minute (RPM) of the engine. As represented in box 204, the system determines whether or not an engine is operating within a stratified regime. As is generally known to those skilled in the art, certain engines operate under a stratified charge regime, particularly at idle speed and relatively low engine speeds. As the engine increases in speed and load, the stratified charge can become increasingly homogeneous and, at very high operating speeds and loads, can become generally homogeneous. The present invention does not rely on a perfectly stratified charge within the combustion chamber. However, certain embodiments of the present invention benefit from applying the method of the present invention only when the charge is at least partially stratified. If the engine is not operating within a stratified regime, the control system shown in FIG. 7 recycles to again monitor the load and speed of the engine. If, on the other hand, the engine is determined to be operating within at least a partially stratified regime, the actual mass air flow through the manifold is determined as represented by block 208. This determination can be made by measuring the manifold air pressure 110 and the temperature 112 as described above in conjunction with equation 5 and FIG. 6. Alternatively, the mass air flow can be directly measured by a mass air flow sensor or hot wire anemometer. The engine control module then selects a desired air flow, as represented by functional block 210, based on the load on the engine and the engine speed. After selecting a desired air flow, the control module sets the throttle plate 104 to a desired position by providing appropriate signals to the stepper motor 130 shown in FIG. 6. This control is continued until the actual air flow equals the desired air flow.

With continued reference to FIG. 7, it should be understood that the present invention is intended as a real time control system that operates as long as the marine propulsion system is operating. However, it should also be recognized that the starting of the engine can be assisted by the present invention which can preposition the throttle plate 104 as the operator begins to start the engine. Based on an instantaneous reading of the barometric pressure, through the use of the manifold absolute pressure sensor, the throttle plate can be prepositioned to an advantageous angle based on initial measurements made before the engine is actually running.

Figure 8:
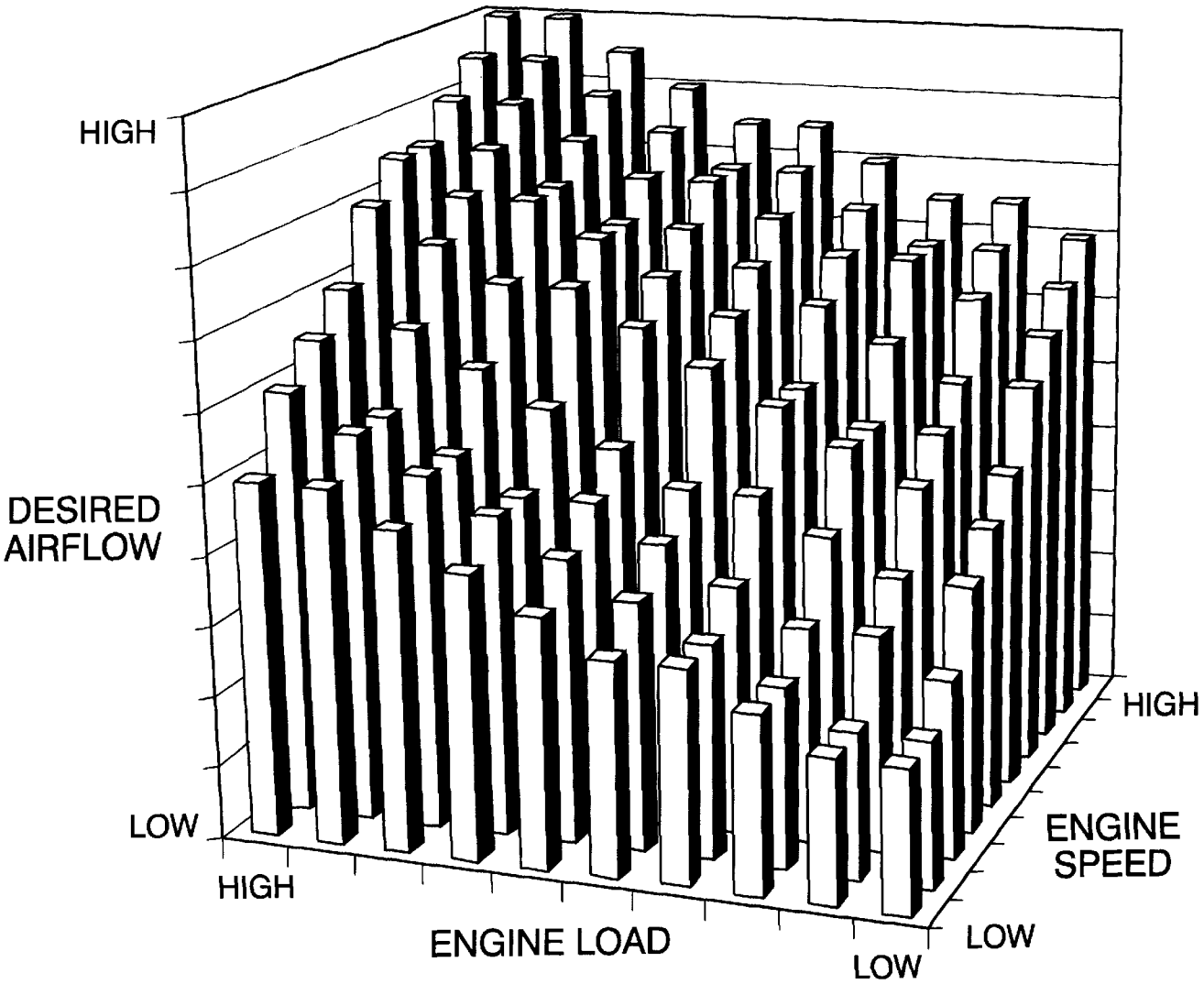
FIG. 8 is a three dimensional graphical representation of the data stored in an engine control module to allow the module to perform the method of the present invention.

With continued reference to FIG. 7, the setting of the throttle, as represented by functional block 214, occurs only after a desired air flow is selected in block 210. FIG. 8 graphically represents a table of empirically determined values stored in the engine control module (ECM) 100 described above in conjunction with FIG. 6. For each of a selected number of engine load magnitudes and engine speed magnitudes, in combination, a desired air flow is stored. As can be seen, the desired air flow magnitude varies as a dual function of engine load and engine speed. At low loads and low speeds, the air flow is at its lowest values and, as load and speed increase, the value of the air flow also increases. The intent and function of the data represented in FIG. 8 and stored in the engine control module is to provide desired air flow information representing the desired air flows for points 26A–26F, shown in FIG. 5, along with many other points that identify an optimal air flow for a given set of engine load and engine speed parameters.

With reference to FIGS. 7 and 8, the block 210 where the system selects the desired air flow is based on the information determined in block 200 and 202. That information, after being compared to the actual air flow measured by the engine control module is used to determine the appropriate position of the throttle plate to assure that the actual air flow is set to the desired air flow.

Although the present invention has been described in particular detail and illustrated to show a preferred embodiment of the present invention, it should be understood that alternative embodiments are also included within its scope.

I claim:

1. A system for controlling the operation of an engine, comprising:

means for creating at least a partially stratified charge of fuel and air within a combustion chamber of said engine;

means for determining a magnitude of a preselected parameter of said engine;

means determining a magnitude of an actual airflow into said combustion chamber;

means, connected in signal communication with said means for determining a magnitude of said preselected parameter, for selecting a desired airflow into said combustion chamber as a function of said preselected parameter; and means, connected in signal communication with said actual airflow magnitude determining means, for changing a throttle position to cause said actual airflow to be generally equal to said desired airflow.

2. The system of claim 1, wherein:

said preselected parameter magnitude determining means comprises a stored table of values of desired airflow as a function of the load on said engine.

3. The system of claim 1, wherein:

said at least partially stratified charge creating means comprises a direct fuel injection system.

4. The system of claim 1, wherein:

said preselected parameter determining means comprises a stored table of values of desired airflow as a function of the speed of said engine and the load on said engine.

5. The system of claim 1, wherein:

said actual airflow determining means comprises a barometric pressure sensor, a manifold pressure sensor, and an air temperature sensor.

6. The system of claim 1, wherein:

said actual airflow determining means comprises a mass airflow sensor.

7. The system of claim 1, wherein:

said actual airflow determining means comprises a hot wire anemometer.

8. A method for controlling the operation of an engine, comprising:

providing at least a partially stratified charge of fuel and air within a combustion chamber of said engine; and controlling a magnitude of airflow into said combustion chamber of said engine, as a function of a preselected parameter of said engine, to achieve a preselected level of optimization of charge purity within said combustion chamber.

9. The method of claim 8, further comprising:

determining a magnitude of a load on said engine, said load being said preselected parameter;

determining a magnitude of an actual airflow into said combustion chamber;

selecting a desired magnitude of airflow into said combustion chamber, as a function of said magnitude of said load, to achieve said preselected level of optimization of scavenging of said combustion chamber as a function of said load on said engine; and changing a throttle position to cause said actual airflow to be generally equal to said desired airflow.

10. The method of claim 9, wherein:

said desired airflow magnitude is determined as a function of a load on said engine and an empirically derived relationship between exhaust pollutants and airflow into said combustion chamber.

11. The method of claim 8, further comprising:

measuring a magnitude of a parameter related to exhaust pollutants; and determining said preselected level of optimization of scavenging as a function of said parameter.

12. A method for controlling the operation of an engine, comprising:

creating at least a partially stratified charge of fuel and air within a combustion chamber of said engine;

determining a magnitude of a preselected parameter of said engine;

determining a magnitude of an actual airflow into said combustion chamber;

selecting a desired magnitude of airflow into said combustion chamber as a function of said magnitude of said preselected parameter; and changing a throttle position to cause said actual airflow magnitude to be generally equal to said desired airflow magnitude.

13. The method of claim 12, wherein:

said preselected magnitude of said parameter is the load on said engine.

14. The method of claim 12, wherein:

said at least partially stratified charge creating step is performed by a direct fuel injection system.

15. The method of claim 12, wherein:

said magnitude of said preselected parameter is calculated as a function of the speed of said engine and the load on said engine.

16. The method of claim 12, wherein:

said actual airflow magnitude is calculated as a function of barometric pressure, manifold pressure, and air temperature.

17. The method of claim 12, wherein:

said actual airflow is measured by a mass airflow sensor.

18. The method of claim 12, wherein:

said actual airflow is measured by a hot wire anemometer.

19. The method of claim 12, wherein:

said desired airflow is determined as a function of said preselected parameter and an empirically derived relationship between exhaust pollutants and airflow into said combustion chamber.

20. The method of claim 12, wherein:

said at least partially stratified charge is provided by a direct fuel injection system.

* * * * *